United States Patent [19]

DeWitt

[11] 4,084,911

[45] Apr. 18, 1978

[54] FLEXIBLE PAPER FASTENER

[75] Inventor: David A. DeWitt, Tewksbury, Mass.

[73] Assignee: Ames Safety Envelope Company, Somerville, Mass.

[21] Appl. No.: 762,653

[22] Filed: Jan. 26, 1977

Related U.S. Application Data

[63] Continuation-in-part of Ser. No. 675,743, Apr. 12, 1976, abandoned.

[51] Int. Cl.[2] ..... B42F 13/04; B42F 13/10

[52] U.S. Cl. ..... 402/15; 24/DIG. 11; 402/18; 402/80 R; 428/483

[58] Field of Search ..... 402/14, 15, 16, 17, 402/18, 75; 24/DIG. 11; 248/467; 428/483

[56] References Cited

FOREIGN PATENT DOCUMENTS

| | | | |
|---|---|---|---|
| 1,297,077 | 6/1969 | Germany | 402/14 |
| 862,775 | 3/1961 | United Kingdom | 402/15 |
| 1,375,975 | 12/1974 | United Kingdom | 402/18 |
| 5,733 of | 1895 | United Kingdom | 402/14 |

*Primary Examiner*—Jerome Schnall

[57] ABSTRACT

A flexible paper fastener of the type having a flexible plastic tubular member flattened at its midportion, a stiff keeper having friction locks engaging opposite end portions of the tubular member, and a stiff U-shaped bridge releasably engaged in the ends of the tubular member is heat sealed along its midportion to a plastic laminated pressure sensitive adhesive sheet for mounting on a support.

2 Claims, 4 Drawing Figures

FLEXIBLE PAPER FASTENER

This application is a continuation-in-part of my copending application Ser. No. 675,743 filed Apr. 12, 1976, now abandoned.

This invention relates to a flexible fastener for securing perforated sheets of paper to a support such as a file folder and pertains more specifically to such a fastener having an improved means for mounting the fastener on a support.

Flexible fasteners have previously been described in Canadian Pat. No. 686,083, issued May 12, 1964 and British Pat. No. 862,775 published Mar. 15, 1961 consisting of an elongated flexible thermoplastic tubular member having opposite ends arranged to extend through spaced apart perforations in the paper sheets and have its intermediate or midportion flattened by welding together and attached to the base by threading or weaving through four spaced slots or holes in a relatively stiff and rigid base which is in turn secured along its length to the file folder as by binding it into the folder. The two free ends of the tubular member, as shown in the Canadian patent, after passing through the perforations of the paper sheets are releasably engaged by the spaced apart ends of a stiff generally U-shaped bridge member, and a stiff keeper is provided having a pair of frictional locks spaced apart by a distance approximately equal to the spacing between the ends of the bridge member, the locks being arranged to engage releasably opposite portions of the flexible tubular member just above the top sheet of perforated paper to retain the sheet in position against the base.

The use of the flexible fastener of the Canadian patent has required manufacture of a special form of file folder having as an additional element, bound to the folder, a stiff base with spaced holes, making the folders more expensive than the simple ones commonly used with other paper fasteners. In addition the threading of the intermediate portion of the flexible tubular member through the holes in the base has been a time consuming and expensive operation requiring the use of hand labor.

The improvement of the present invention eliminates both the base and the step of threading the tubular member through its holes, making it possible to attach the flattened intermediate portion of the flexible tubular member directly to any ordinay folder or other support in a simple one-step operation readily adapted to mechanization.

Figure 1:
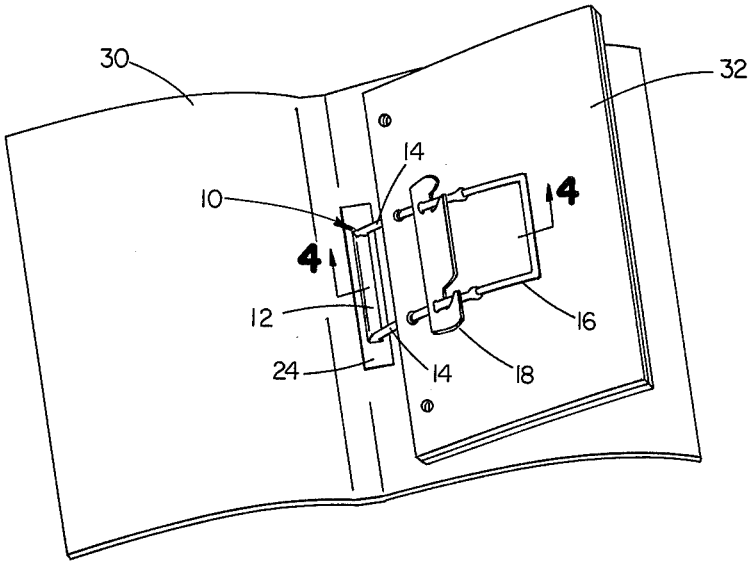
FIG. 1 is an isometric view of a file folder having an improved paper fastener of the present invention mounted in place and holding a stack of perforated paper sheets.
Figure 2:
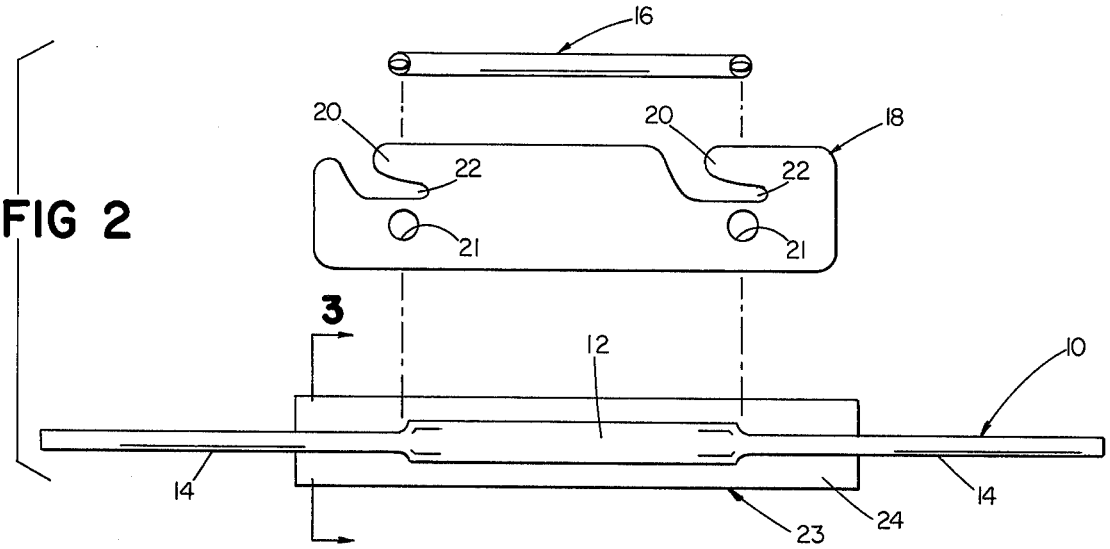
FIG. 2 is an exploded view on an enlarged scale showing the several parts of the fastener.
Figure 3:
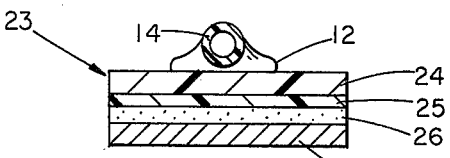
FIG. 3 is a view in section taken along lines 3—3 of FIG. 2.
Figure 4:
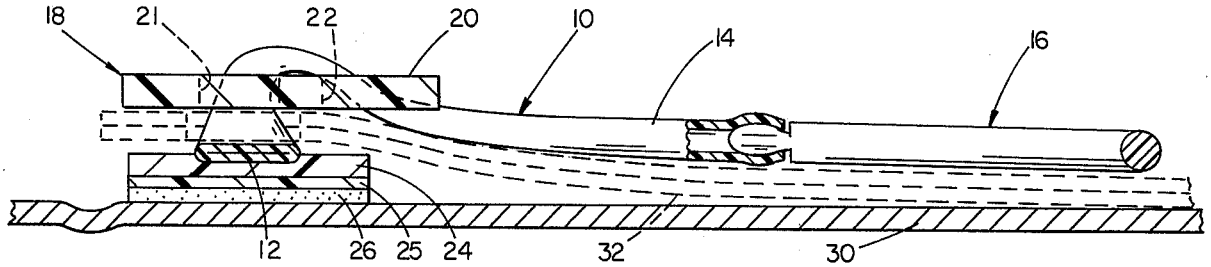
FIG. 4 is a view in section taken along lines 4—4 of FIG. 1.

As shown in the drawings, the flexible fastener consists of a flexible thermoplastic tubular member 10 having a flattened midportion 12 together with opposite tubular end portions 14,14, a stiff generally U-shaped bridge member 16, the spaced apart ends of which releasably engage in opposite ends of tubular member 10 and a stiff keeper 18 provided with spaced friction 20,20, each of which includes a hole 21 closely adjacent a slot 22 through which the opposite end portions of the flexible tubular member are passed.

The improved mounting means comprises a flexible resilient laminated sheet 23 having an upper facing layer or laminate of thermoplastic material such as vinyl resin 24, which layer has a softening temperature within 5° C. of the softening temperature of tubular member 10. Layer 24, which preferably has a thickness or gauge from 8 to 16 mils, is bonded throughout the extent of its bottom surface directly to an underlying intermediate reinforcing layer 25 coextensive in area with the bottom surface of facing layer 24. Reinforcing layer 25 consists essentially of tear-resistant polyester (polyethylene terephthalate) film having a softening temperature of at least 150° C. and at least 40° C. higher than that of layer 24, and preferably has a thickness or gauge from 0.1 to 3 mils. Such film is available commercially under the trade name Mylar. A lower adhesive layer 26 of conventional pressure sensitive adhesive is bonded directly to and coextensive in area with the lower surface of reinforcng layer 25. The thickness of adhesive layer 26 is not critical and may vary over a wide range from as little as 0.5 mil or less to 2 mills or more. Laminated sheet 25 can be made by conventional procedures employing casting, calendering or extruding techniques,. A temporary protective cover sheet 28 is provided at the bottom exposed surface of adhesive layer 26, the temporary protective sheet having a smooth non-adherent surface and being readily removed from the adhesive surface before use of the flexible fastener.

Laminated sheet 23 must have a length as least 20% longer than the length of the intermediate flattened portion 12 of flexible tubular member 10 which is preferably approximately equal to the spacing between the ends of the bridge member 16 and the distance between friction locks 20,20 so that when the fastener is assembled for use the opposite end portions 14,14 of the flexible tubular member are approximately parallel throughout their length. The width of laminated sheet 23 is preferably at least 6 times the diameter of tubular member 10 to provide adequate purchase for securing the flexible fastener to the base.

In manufacturing the flexible fastener, midportion 12 of the flexible thermoplastic tubular member is heat sealed and simultaneously flattened under pressure, being bonded directly to the top surface of upper lamination 24. Reinforcing layer 25 acts both to prevent excessive flow of upper thermoplastic vinyl resin layer 24 and of pressure sensitive adhesive layer 26 during the heat sealing operation and also to provide adequate tear strength for laminated sheet 23 during use of the flexible fastener. Omission of reinforcing layer 25 results in an unsatisfactory product having very poor tear strength particularly along the margins of the flattened midportion of the tubular member 10, apparently because of excessive flow of the thermoplastic vinyl resin during the heat sealing operation.

To use the flexible fastener, temporary protective covering 28 is peeled off the adhesive surface and the assemblage is pressed against file folder 30 in the appropriate location adjacent the fold. The paper sheets 32 are provided with a pair of spaced perforations, the spacing between which is approximately equal to the length of flattened intermediate portion 12 of tubular member 10.

Paper sheets can be added to or removed from the flexible fastener simply by disengaging the tubular member from slots 22 of the keeper, sliding the keeper onto bridge member 16 by moving it to the right as seen in FIG. 1, then separating bridge member 16 from the ends of tubular member 10.

What is claimed is:

1. A fastener for securing perforated sheets of paper to a base such as a file folder comprising an elongated flexible thermoplastic tubular member having opposite end portions arranged to extend through spaced apart perforations in said sheets and a flattened intermediate portion for attachment to said base, a stiff generally U-shaped bridge member having its ends spaced apart by a distance approximately equal to the length of said flattened intermediate portion of the tubular member and arranged to engage releasably with opposite ends of said tubular member to maintain them spaced apart, and a stiff keeper having a pair of friction locks spaced apart by a distance approximately equal to the spacing between said ends of said bridge member, said locks being arranged to engage releasably opposite portions of said flexible tubular member, wherein the improvement comprises a flexible resilient laminated plastic sheet having a length at least 20% longer than the length of said flattened intermediate portion of said tubular member, and having an upper facing layer thereof heat sealed to said flattened intermediate portion throughout its length, and having on its opposite face extending throughout its area a layer of pressure sensitive adhesive for adhering said sheet to said base, and a temporary protective cover sheet at the bottom exposed surface of said pressure sensitive adhesive layer, said tubular member and the upper facing layer of said laminated sheet both being vinyl resin and having softening temperatures within 5° C of each other, and said laminated sheet having an intermediate polyester reinforcing layer between said upper facing layer and said pressure sensitive adhesive layer, said intermediate polyester reinforcing layer having a softening temperature of at least 150° and more than 40° C above the softening temperature of said upper facing layer.

2. A fastener as claimed in claim 1 in which said upper facing layer has a thickness from 8 to 16 mils, said intermediate reinforcing layer has a thickness from 0.1 to 3 mils, and said adhesive layer has a thickness from 0.5 to 2 mils.

* * * * *

UNITED STATES PATENT AND TRADEMARK OFFICE

CERTIFICATE OF CORRECTION

PATENT NO. : 4,084,911
DATED : April 18, 1978
INVENTOR(S) : David A. DeWitt

It is certified that error appears in the above-identified patent and that said Letters Patent are hereby corrected as shown below:

Under "References Cited", delete "of" after "5,733";

Column 1, line 47, "ordinary" is misspelled;

Column 1, line 66, after "10", insert a comma;

Column 1, line 67, after "friction", insert --locks--;

Column 2, line 25, delete the comma after "techniques";

Column 2, line 31, "as" should be --at--;

Column 2, line 35, delete "the" before "bridge";

Column 2, line 55, after "midportion", insert --12--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*